US007862196B1

(12) United States Patent
Pever et al.

(10) Patent No.: US 7,862,196 B1
(45) Date of Patent: Jan. 4, 2011

(54) BALUSTER LIGHT SYSTEM

(75) Inventors: Steve E. Pever, Bellefontaine, OH (US); Timothy C. Rothwell, Dublin, OH (US)

(73) Assignee: The Crane Group Companies Limited, Columbus, OH (US)

( * ) Notice: Subject to any disclaimer, the term of this patent is extended or adjusted under 35 U.S.C. 154(b) by 221 days.

(21) Appl. No.: 12/049,967

(22) Filed: Mar. 17, 2008

(51) Int. Cl.
*F21S 8/00* (2006.01)

(52) U.S. Cl. ..... 362/152; 362/145; 362/240

(58) Field of Classification Search ..... 362/145–147, 362/152, 153, 153.1, 240, 267, 276, 297, 362/328, 329, 362, 364, 368, 371, 375, 411, 362/414, 431, 432, 576; 256/65.01, 65.02
See application file for complete search history.

(56) References Cited

U.S. PATENT DOCUMENTS

| | | | | |
|---|---|---|---|---|
| 2,092,989 | A * | 9/1937 | Sorensen et al. | 362/432 |
| 2,657,367 | A | 10/1953 | Brooks | |
| 2,721,255 | A * | 10/1955 | Lanmon | 362/146 |
| 2,742,549 | A | 4/1956 | Peters | |
| 3,448,257 | A | 6/1969 | Sackett, Jr. | |
| 4,080,034 | A | 3/1978 | Werner | |
| 4,270,830 | A | 6/1981 | Brenner | |
| 4,648,675 | A | 3/1987 | Gaines | |
| 4,888,669 | A | 12/1989 | Hanson | |
| 4,951,184 | A | 8/1990 | Makurof | |
| 5,001,611 | A | 3/1991 | Beachy et al. | |
| 5,007,855 | A | 4/1991 | O'Brien et al. | |
| 5,057,979 | A | 10/1991 | Carson et al. | |
| 5,429,530 | A | 7/1995 | Zander et al. | |
| 5,493,825 | A | 2/1996 | Gaston | |
| 5,642,934 | A | 7/1997 | Haddad | |
| 5,658,071 | A | 8/1997 | Kelpin | |
| 5,701,236 | A | 12/1997 | Viviano | |
| 6,004,154 | A | 12/1999 | O'Brien | |
| 6,425,676 | B1 | 7/2002 | Lyons | |
| 6,467,928 | B2 | 10/2002 | Crelin | |
| 6,585,398 | B1 | 7/2003 | Haddad | |
| 6,742,748 | B1 | 6/2004 | Gretz | |
| 6,779,907 | B2 | 8/2004 | Beadle | |
| 6,941,715 | B2 | 9/2005 | Potter | |
| 7,021,786 | B1 | 4/2006 | Sandor, Sr. | |
| 7,036,960 | B1 | 5/2006 | Gretz | |
| 7,419,276 | B2 * | 9/2008 | Sheridan | 362/152 |
| 2002/0191391 | A1 | 12/2002 | Van Etten | |
| 2004/0095772 | A1 | 5/2004 | Hoover et al. | |
| 2005/0128758 | A1 | 6/2005 | Brick | |

(Continued)

OTHER PUBLICATIONS

Elights.Com, Progress P8651 Quick Connector Landscape Accessory, printed May 8, 2008, 1 page, http://www.elights.com/p8651.html.

(Continued)

*Primary Examiner*—Hargobind S Sawhney
(74) *Attorney, Agent, or Firm*—Standley Law Group LLP

(57) ABSTRACT

A lighting system for illuminating a deck area. The wiring for the lighting system may be hidden from view, providing a more aesthetically pleasing appearance. Furthermore, the lighting system may be installed simultaneously with the deck itself, or afterwards. Embodiments of the present invention include baluster lights which may be mounted between the railing balusters and also mounted to the sides of posts. Embodiments of the present invention also protect the lighting system from environmental damage.

18 Claims, 4 Drawing Sheets

U.S. PATENT DOCUMENTS

2006/0221617 A1* 10/2006 Chien ..... 362/311

OTHER PUBLICATIONS

Elights.Com, Kichler 15509 Quick Disk Low Voltage Cable Connector, printed May 8, 2008, 1 page, http://www.elights.com/quiccon.html.

Hadco, Connector (LVC3), printed May 8, 2008, 1 page, http://www.hadco.com/hadco/Public/ProductDetail.aspx?pid=1149&Id=16.

Hadco, Connector (LVC4), printed May 8, 2008, 1 page, http://www.hadco.com/hadco/Public/ProductDetail.aspx?pid=1150&Id=16.

* cited by examiner

BALUSTER LIGHT SYSTEM

BACKGROUND AND SUMMARY OF THE INVENTION

Embodiments of the present invention relate generally to lighting systems for outdoor deck areas, for lighting purposes as well as decorative purposes, and more particularly to several embodiments of a baluster light.

Outdoor deck areas are very popular as they add to the beauty of the home as well as provide a functional place to enjoy the outdoors. However, many decks do not have a sufficient lighting such that they can be enjoyed during the night time as well as the day time. Furthermore, the decks that currently employ lighting systems must run the wiring on the surface of the posts, railings, and deck surface, providing a look that is not aesthetically pleasing. Occasionally the wires are hidden by a conduit, but these materials are still not aesthetically pleasing.

Exemplary embodiments of the present invention provide a lighting system for an outdoor deck area that provides sufficient lighting while at the same time adding to the aesthetic value of the area. Therefore, exemplary embodiments of the present invention may substantially hide the wires from view and incorporate the light housings into the deck materials.

Embodiments of the present invention provide a lighting system that may be built specifically for the deck including the deck surface, railings, and posts to provide a total deck experience. Also, the deck may not need to be torn up and rearranged to put in the lighting system. The deck may be manufactured to allow the easy installation of the lighting system.

The lighting system does not have to be tailor-made for every home, but can be manufactured at a high production rate and can be installed at existing homes or businesses. Also, the embodiments do not need to be installed by a specialized carpenter, but instead can be installed by the homeowner. In this way, cost is minimized.

Embodiments of the present invention may protect the lighting assembly from environmental damage, including but not limited to water damage and insect damage.

Embodiments of the present invention include baluster lights which are mounted between the railing balusters and also mounted to the sides of posts.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Exemplary embodiments of the present invention are directed to the figures described herein.

Figure 1A:
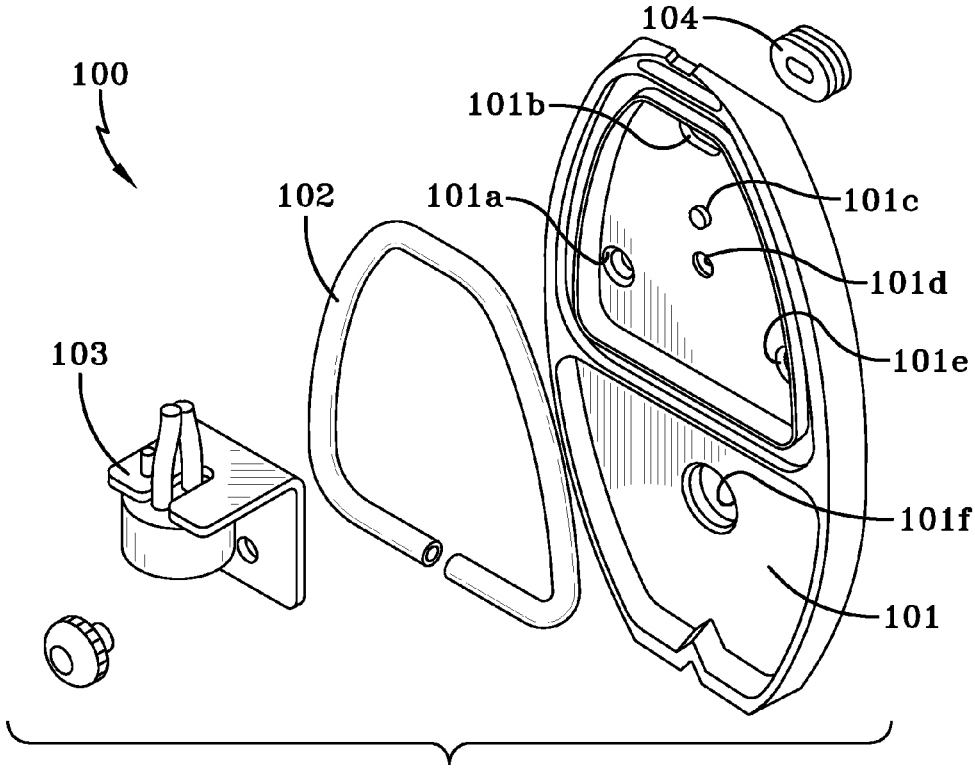
FIG. 1*a* is an exploded view of a back plate.

FIG. 1*a* is an exploded view of an exemplary embodiment of a back plate assembly 100. The lamp assembly 103 attaches to the back plate or back plate housing 101. In this embodiment, back plate 101 may comprise one or more voids to facilitate passage through the back plate 101 or various connections as shown in the figures (e.g., voids 101*a*, 101*b*, 101*c*, 101*d*, 101*e*, and 101*f*). Also in this embodiment, insulation 102 (e.g., which may be comprised of silicone) fits into the back plate 101 to surround or encircle the lamp assembly 103 and protect the lamp assembly 103 from environmental damage including, but not limited to, water or insect damage. Furthermore, in this embodiment, a grommet 104 attaches to the back plate 101 to allow wiring to pass through the void 101*b* in the back plate 101 and connect to lamp assembly 103 but still maintain a seal around the lamp assembly 103 and protect the lamp assembly 103 from environmental damage including but not limited to water or insect damage (e.g., by the grommet 104 encircling the wiring). In an exemplary embodiment, the grommet 104 may be comprised of rubber.

Figure 1B:
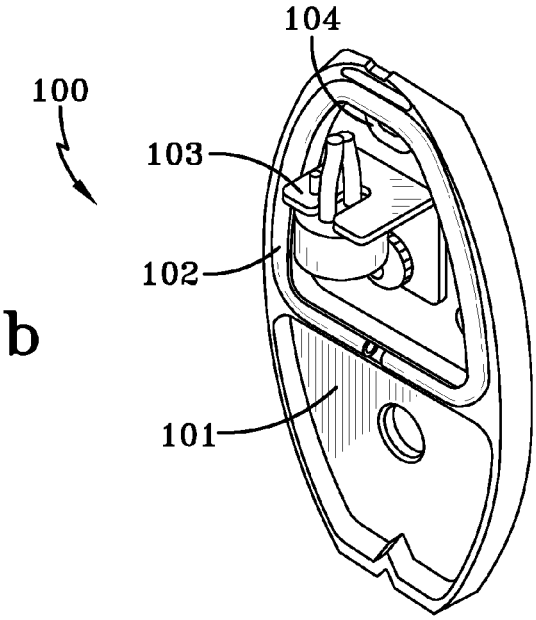
FIG. 1*b* is a perspective view of a back plate completely assembled.

FIG. 1*b* is a perspective view of a back plate assembly 100 completely assembled.

Figure 2A:
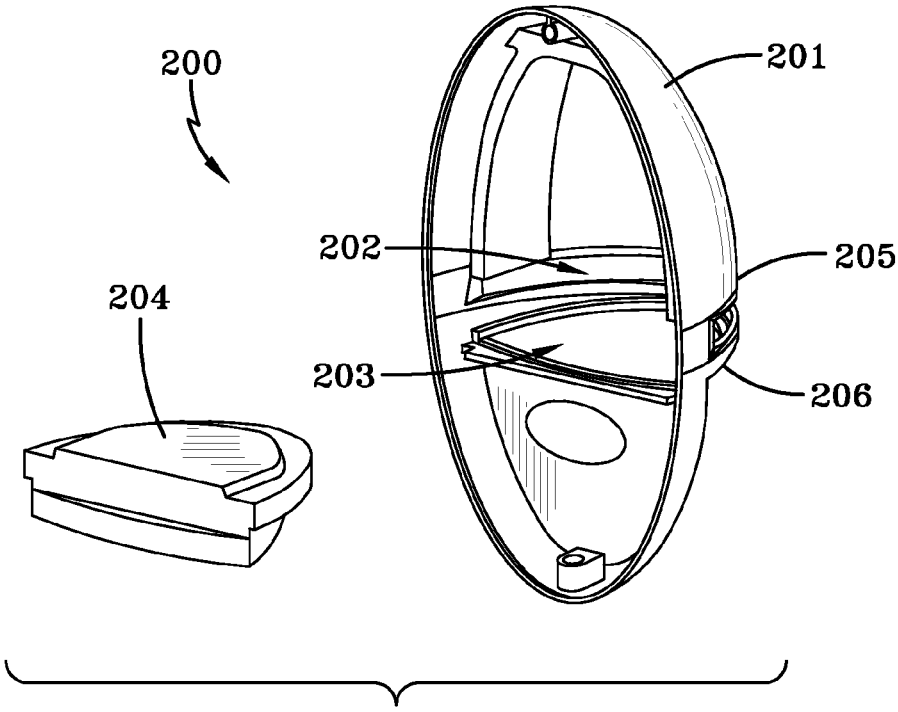
FIG. 2*a* is an exploded view of a light cover.

FIG. 2*a* is an exploded view of an exemplary embodiment of a light or front cover assembly 200. The cover housing or front cover 201 comprises a horizontal void 202 and a vertical void 203. The lens 204 fits within the horizontal void 202 and vertical void 203. In this exemplary embodiment, the horizontal void 202 in front surface 205 of front cover 201 is small in comparison to the relatively larger vertical void 203 in bottom surface 206 of front cover 201. In an exemplary embodiment, the lens 204 may be transparent, etched, frosted, tinted, or textured, and the front cover 201 may be opaque. Also, in an exemplary embodiment, attachment of front cover 201 to back plate 101 is adapted to create a seal between the front cover assembly 200 and the back plate assembly 100 as the front cover 201 covers the lamp assembly 103. As aforementioned, insulation 102 and/or grommet 104 may assist with the creation of the seal. For example, insulation 102 may be between the front cover 201 and the back plate 101 when installed in order to create a seal.

Figure 2B:
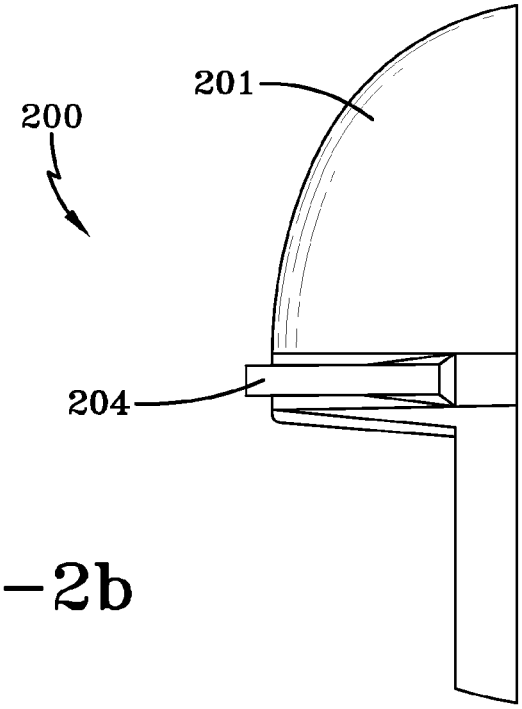
FIG. 2*b* is a perspective view of a light cover completely assembled.

FIG. 2*b* is a perspective view of a light or front cover assembly 200 completely assembled.

Figure 3A:
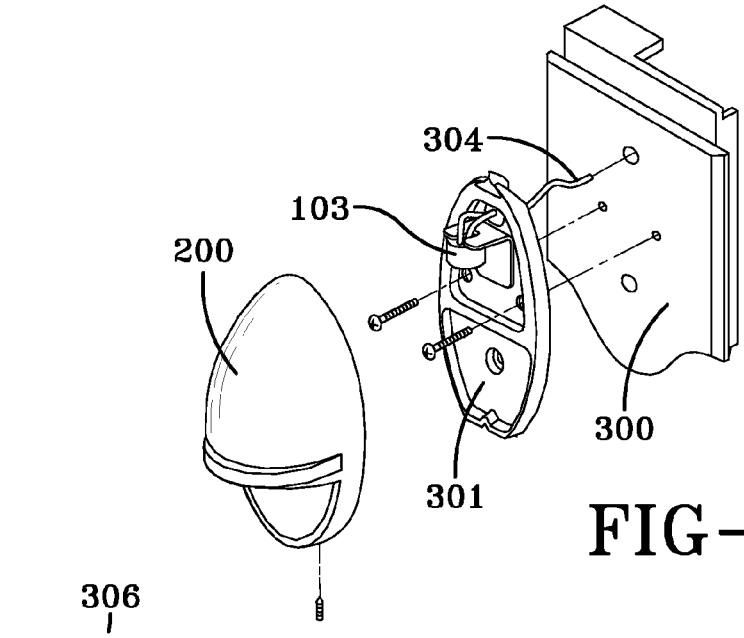
FIG. 3*a* is an exploded view of a back plate, light cover, and a front mounting block.
Figure 3B:
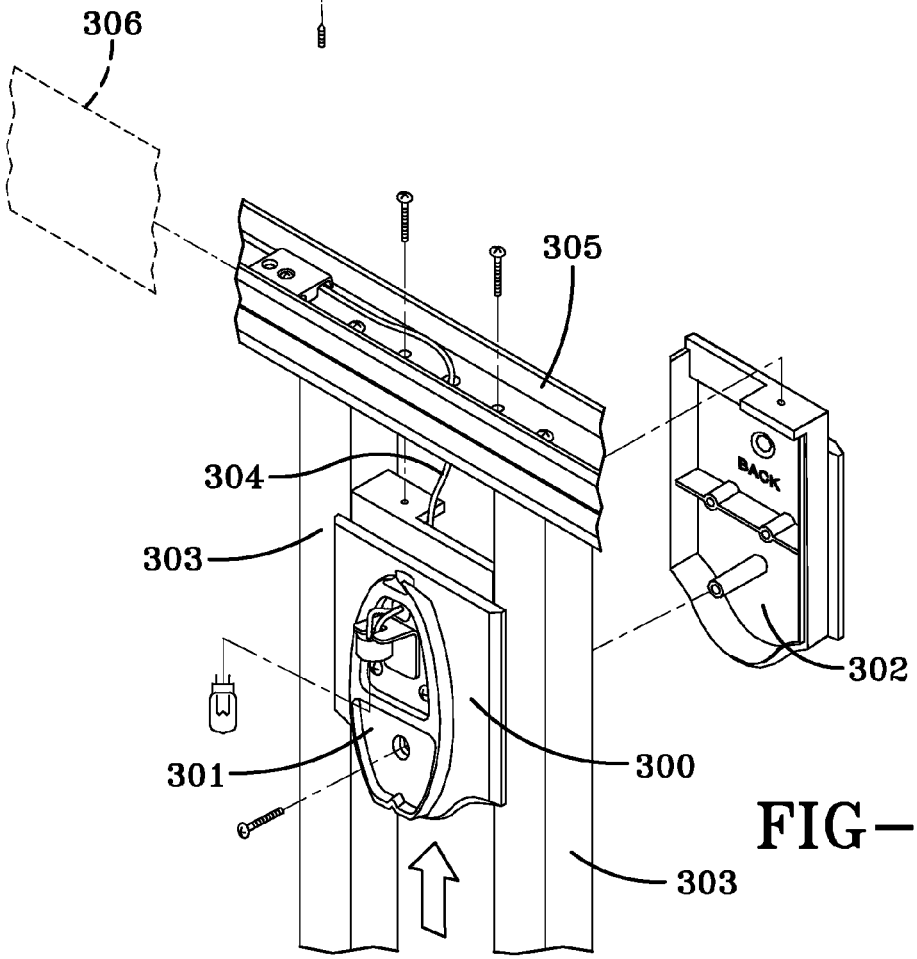
FIG. 3*b* is an exploded view of a back plate, a front mounting block, a rear mounting block, and their attachment between railing balusters.
Figure 4A:
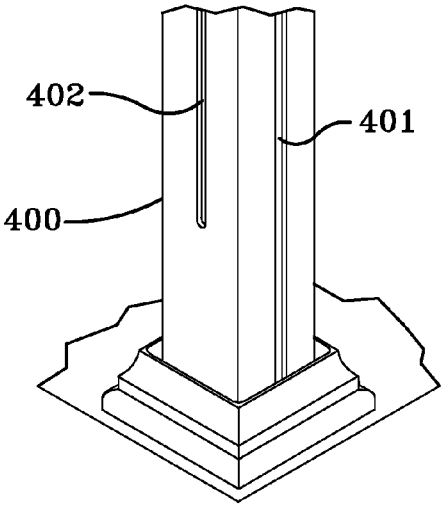
FIG. 4*a* is an illustration of a post without a post cover.
Figure 4B:
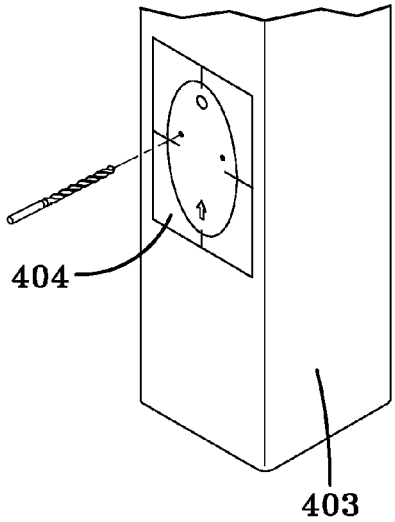
FIG. 4*b* is an illustration of a post cover with an embodiment of an attachment jig.
Figure 4C:
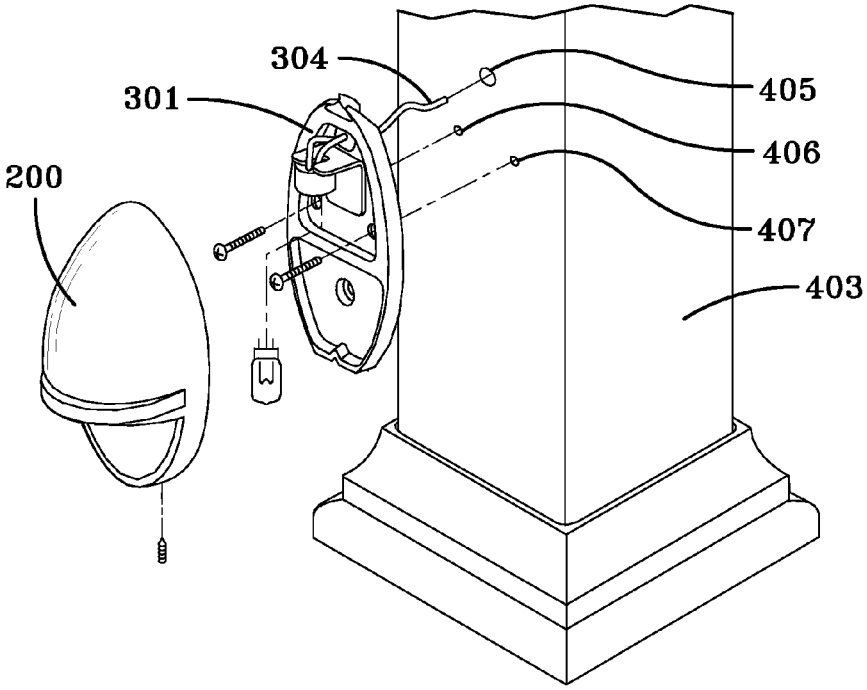
FIG. 4*c* is an exploded view of a post with a post cover, a back plate, and a cover.

FIGS. 3*a*, 3*b*, and 4*c* show examples of how a lighting system may be attached to various embodiments of deck supports. In these embodiments, a back plate assembly comprising a back plate 301 is adapted to be attached to the deck supports.

FIG. 3*a* is an exploded view of exemplary embodiments of a back plate 301, light or front cover assembly 200, and a front mounting block 300. Wiring 304 passes through the front mounting block 300 and the back plate 301 to reach the lamp assembly 103. The back plate 301 attaches to the front mounting block 300. The light or front cover assembly 200 attaches to the back plate 301.

FIG. 3*b* is an exploded view of a back plate 301, a front mounting block 300, a rear mounting block 302, and their attachment between railing balusters 303, which are attached to railing 305 and may be vertical. In this exemplary embodiment, the deck rail assembly may also comprise a rail cover 306. Wiring 304 passes through the railing 305, which may be horizontal, and further between the front mounting block 300 and the rear mounting block 302. The wiring 304 then passes through the front mounting block 300 and through a void in the back plate 301 and attaches to the lamp assembly 103. As the front mounting block 300 attaches to the rear mounting block 302, the railing balusters 303 become positioned (e.g., trapped or compressed) in between the two mounting blocks and thus secure the assembly in place. Once the wiring 304 has been installed, the front mounting block 300 and rear mounting block 302 may abut against the bottom surface of the railing 305. FIG. 3*b* shows an embodiment in which fasteners extend through railing 305 to secure front mounting block 300 and rear mounting block 302 to railing 305. As the wiring 304 passes within or along the rail 305, a rail cover 306 can fit over or attach to the rail 305 and can be used to completely hide the wiring 304 from view (e.g., enclose the wiring 304 along the rail 305).

FIGS. 4*a*, 4*b*, and 4*c* show embodiments of the baluster light when mounted on a post 400 (e.g., a vertical post) with a post cover 403. In this embodiment, the post cover 403 encloses the post 400. The deck, post 400, and post cover 403 may be made from well known materials such as, but not limited to, wood, plastic, wood composites, and/or metal. In one embodiment, the wiring 304 passes between the post 400 and the post cover 403. In another embodiment, the wiring 304 passes between the post 400 and the post cover 403 but within notch 402. The wiring 304 may also pass between the post 400 and the post cover 403 but within notch 401. A jig 404 may be used to create the holes 405, 406, and 407. Hole 405 may be used to allow the wiring 304 to pass through the post cover 403 and then through a void in back plate 301 to connect to the lamp assembly 103. Holes 406 and 407 can be used to facilitate the mounting of the back plate 301 to a side (e.g., vertical side) of the post cover 403 and the post 400. The light or front cover assembly 200 then attaches to the back plate 301.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A lighting system attached to a deck support, said system comprising:

a back plate assembly attached to said deck support, comprising:

a back plate comprising one or more voids; and a lamp assembly connected to said back plate; and a front cover assembly attached to said back plate, comprising:

a front cover comprising a horizontal void and a vertical void; and a lens fit within said horizontal void and said vertical void;

wherein said front cover attachment creates a seal between said front cover assembly and said back plate assembly; and wherein one of said voids in said back plate is adapted to allow wiring to pass through said back plate and connect to said lamp assembly.

2. The system of claim 1 further comprising:

insulation encircling said lamp assembly;

wherein said front cover attachment creates a seal with said insulation.

3. The system of claim 1 wherein:

said back plate assembly is attached to said deck support, said deck support comprising:

(a) a rail;

(b) two or more balusters attached to said rail;

(c) a rear mounting block; and (d) a front mounting block attached to said rear mounting block;

wherein said attachment causes two of said balusters to be positioned between said front mounting block and said rear mounting block such that said front mounting block and said rear mounting block abut a bottom surface of said rail; and wherein said wiring passes between said rear and front mounting blocks, and through said front mounting block before passing through one of said voids in said back plate to connect to said lamp assembly.

4. The system of claim 3 further comprising a rail cover attached to said rail;

wherein said wiring passes along said rail and through said rail before passing between said rear and front mounting blocks; and wherein said rail cover encloses said wiring along said rail when said rail cover is attached to said rail.

5. The system of claim 4 further comprising a grommet attached to said void in said back plate where the wiring passes through said back plate.

6. The system of claim 1 wherein:

said back plate assembly is attached to said deck support, said deck support comprising:

(a) a post; and (b) a post cover enclosing said post;

wherein said wiring passes between said post and said post cover and through said post cover before passing through one of said voids in said back plate to connect to said lamp assembly.

7. The system of claim 6 further comprising a grommet attached to said void in said back plate where the wiring passes through said back plate.

8. The system of claim 1 wherein:

said lens is transparent and/or any one of the following: etched, frosted, tinted, or textured; and said front cover is opaque.

9. A lighting system attached to a deck rail assembly comprising a rail and two or more balusters connected to said rail, said lighting system comprising:

a rear mounting block;

a front mounting block attached to said rear mounting block, wherein said attachment causes two of said balusters to be positioned between said front mounting block and said rear mounting block such that said front mounting block and said rear mounting block abut a bottom surface of said rail;

a back plate attached to said front mounting block;

a lamp assembly attached to said back plate; a front cover attached to said back plate, said front cover comprising a front surface that defines a horizontal void and a bottom surface that defines a vertical void; a lens fitted within said horizontal void and said vertical void wiring running along said rail, passing through said rail, passing between said front and rear mounting blocks, passing through said front mounting block and back plate, and attached to said lamp assembly; and a front cover attached to said back plate and covering said lamp assembly.

10. The system of claim 9 wherein:

said deck rail assembly further comprises a rail cover attached to said rail; and said rail cover covers said wiring passing along said rail.

11. The system of claim 9 wherein the attachment of said front cover to said back plate creates a seal around said lamp assembly.

12. The system of claim 11 further comprising:

insulation between the front cover and back plate, encircling said lamp assembly; and a grommet attached to said back plate, encircling said wiring as it passes through said back plate.

13. The system of claim 12 wherein said insulation is silicone.

14. A lighting system attached to a post wherein said post is covered by a post cover, said lighting system comprising:

a back plate attached to a side of said post cover;

a lamp assembly attached to said back plate;

wiring running between said post and post cover, passing through said post cover and back plate, and connected to said lamp assembly;

a front cover attached to said back plate and covering said lamp assembly; said front cover comprising a small horizontal void in a front surface and a relatively larger vertical void in a bottom surface; a lens fitted within said horizontal void and said vertical void;

insulation between the front cover and back plate, encircling said lamp assembly; and a grommet attached to said back plate, encircling said wiring as it passes through said back plate;

wherein the attachment of said front cover to said back plate creates a seal around said lamp assembly.

15. The system of claim 14 wherein said insulation is silicone.

16. The system of claim 14 wherein said grommet is rubber.

17. The system of claim 14 wherein said front cover comprises:

a front cover comprising a small horizontal void on a front surface and a relatively larger vertical void on a bottom surface; and a lens adapted to fit within said horizontal and vertical voids.

18. The system of claim 17 wherein:

said lens is transparent and/or any one of the following: etched, frosted, tinted, or textured; and said front cover is opaque.

* * * * *